US005806366A

United States Patent [19]

Vilou

[11] Patent Number: 5,806,366

[45] Date of Patent: Sep. 15, 1998

[54] STARTER HEAD AND A MOTOR VEHICLE STARTER HAVING SUCH A HEAD

[75] Inventor: Gérard Vilou, Tassin, France

[73] Assignee: Valeo Equipements Electriques Moteur, Creteil, France

[21] Appl. No.: 712,805

[22] Filed: Sep. 12, 1996

[30] Foreign Application Priority Data

Sep. 12, 1995 [FR] France ..... 95 10744

[51] Int. Cl.[6] ..... F02N 15/06

[52] U.S. Cl. ..... 74/7 R; 74/7 A; 290/38 R

[58] Field of Search ..... 74/7 A, 7 R, 6, 74/7 C; 290/38 R, 48

[56] References Cited

U.S. PATENT DOCUMENTS

| | | | |
|---|---|---|---|
| 4,524,629 | 6/1985 | Digby | 74/7 R |
| 4,744,258 | 5/1988 | Volino | 74/7 R |
| 4,916,958 | 4/1990 | Okamoto et al. | 74/7 R X |
| 5,099,703 | 3/1992 | Isozumi | 74/7 R X |
| 5,331,860 | 7/1994 | Demoule et al. | 74/7 R |

FOREIGN PATENT DOCUMENTS

| | | |
|---|---|---|
| 552 081 | 1/1992 | European Pat. Off. . |
| 709486 | 8/1941 | Germany . |

OTHER PUBLICATIONS

French Search Report dated 24 May 1996.

*Primary Examiner*—Charles A. Marmor
*Assistant Examiner*—Troy Grabow

[57] ABSTRACT

A motor vehicle starter head includes a starter pinion which slides axially on a starter head shaft, an actuator coupled with the pinion for axial movement with the latter, and abutment means for limiting the travel of the pinion in sliding movement with respect to the starter head shaft, at least towards its working position. The actuator has internal splines cooperating with external splines on the starter head shaft, and the abutment means comprise an abutment member which is coupled for axial movement with the actuator and which cooperates with a transverse flank of the external splines on the shaft.

9 Claims, 5 Drawing Sheets

STARTER HEAD AND A MOTOR VEHICLE STARTER HAVING SUCH A HEAD

FIELD OF THE INVENTION

The present invention relates to a starter for an internal combustion engine for a motor vehicle. More particularly, the invention relates to a starter of the type comprising a starter head which is acted on by one end of a control lever, the head including a starter pinion which is mounted for axial sliding movement on a shaft of the starter head, between a withdrawn or rest position and an extended or working position.

More particularly, the starter is of the kind in which the lever applies an actuating force through an interposed actuator or driving element, which is coupled to the starter pinion for axial movement with the latter, and in which the body of this actuator comprises a sleeve portion which is mounted for sliding movement on the starter head shaft, the body having an internal bore, part of which is formed with internal splines which cooperate with splines formed externally on a portion of the starter head shaft, with the starter head further including abutment means for limiting the course of travel, in axial sliding movement, of the starter pinion with respect to the starter head shaft, at least in the direction towards its working position.

BACKGROUND OF THE INVENTION

In a known design of a starter of the above general type, the abutment means consist of an annular or toroidal ring mounted in an internal radial groove which is formed in the internal bore of the cylindrical starter head pinion. This ring projects radially inwardly so as to lie in facing relationship with an abutment collar portion, which is part of an end stop screw or stud screwed into the free end of the starter head shaft.

When the starter pinion is displaced axially with respect to the starter head shaft from its rest position, it slides axially on the latter until the abutment ring comes into cooperation with the collar portion of the end stop screw. In the rest position, it is the free rear transverse end face of the sleeve portion of the starter head pinion actuator that comes into engagement on a shoulder of the starter head shaft.

In order to enable the various components to be assembled together, the front end of the starter pinion is accordingly an open end, which is closed and sealed by means of an attached sealing cap. A starter pinion made to such a design is therefore very complex to make, in particular in terms of machining, because the internal radial groove which receives the abutment ring has to be located very precisely. In addition, the drilling and screw cutting or tapping operations in the free end of the starter head shaft, in order that the end stop screw can be fitted in the latter, are expensive to carry out, and they also have the disadvantage that they weaken the shaft itself.

The starter head pinion is guided by means of two guide sleeves or cradle members, which are interposed between the internal bore of the starter head pinion and the cylindrical outer wall of the starter head shaft. Because of the presence of the abutment ring, the leading one of these guide sleeves is located in an axial position which is spaced by quite a large amount away from the free end of the body of the starter head pinion. The teeth of this pinion mesh with the toothed starter crown carried on the flywheel of the internal combustion engine to be started.

The leading guide sleeve is thus somewhat remote from the zone in which the forces arising during engagement of the starter on the starter crown are generated. As a result, there is a substantial cantilever which is prejudicial to the integrity of the guide sleeve itself, as the latter tends to become overloaded. This cantilever is also detrimental to obtaining the best meshing conditions, the latter being affected by the resulting bending of the starter head shaft. Finally, it is necessary to apply a specific adhesive to the screw thread of the end stop screw, so as to avoid any risk of the latter becoming loose.

DISCUSSION OF THE INVENTION

An object of the present invention is to propose a new design for a starter within the field of the invention, which overcomes the drawbacks discussed above.

According to the invention, a motor vehicle starter of the type comprising a starter head on which there acts one end of a control lever, and which includes a starter head pinion mounted for axial movement on a starter head shaft between a rear or rest position and a front or working position, and on which the lever acts through an actuator which is coupled with the starter head pinion for axial straight line movement therewith, the body of the said actuator comprising a sleeve portion which is mounted for sliding movement on the starter head shaft, and which has an internal bore including a splined portion, the internal splines of which cooperate with external splines of a splined portion of the starter head shaft, the starter being further of the type including abutment means for limiting the course of travel in axial sliding movement of the starter head pinion with respect to the starter head shaft, at least towards its working position, is characterised in that the said abutment means comprise an abutment member which is coupled with the actuator for axial straight line movement with the latter, and which is adapted to cooperate with a transverse flank of the external splines of the starter head shaft, the said transverse flank constituting the rearward end of the said external splines.

According to a preferred feature of the invention, the said abutment member is an abutment ring mounted in an internal radial mounting groove formed in the internal bore of the sleeve portion, with the abutment ring projecting axially inwardly in alignment with the transverse flank of the internal splines of the sleeve portion which constitutes the rearward end of the said internal splines. The mounting groove in which the abutment ring is fitted is then preferably delimited axially by a radial rear face, and the axial distance separating the front and rear radial faces of the mounting groove for the abutment ring is preferably greater than the axial thickness of the abutment ring.

According to another preferred feature of the invention, the diameter of the mounting groove in which the abutment ring is fitted is greater than the outer diameter of the abutment ring itself, the latter being adapted to be elastically deformed radially outwardly into its mounting groove. The abutment ring is preferably in the form of a split toroidal ring.

According to a further preferred feature of the invention, the sleeve portion of the actuator is made in one piece, the said mounting groove for the abutment ring being formed in its internal bore.

In another embodiment of the invention, the sleeve portion of the actuator terminates axially in line with the rear transverse flank of the internal splines of the sleeve portion, the sleeve portion being provided with an attached separate member, in the general form of a ring or shroud which extends the rear end of the sleeve portion axially, the mounting groove in which the abutment member is mounted being formed in the said ring or shroud. In this arrangement, the ring or shroud is preferably mounted on the outer cylindrical wall of the sleeve portion, being positioned axially on the latter in axial engagement against an external radial abutment shoulder.

In a preferred form of starter with this last mentioned arrangement, the sleeve portion has an external radial collar made in the form of a disc, with a central hole through which passes the external cylindrical surface of the sleeve portion, the said collar being positioned axially with respect to the sleeve portion in axial abutment against the said external radial shoulder. Preferably, the said collar then includes a seaming flange made in the form of an annular cylindrical extension which extends axially from a lateral face of the disc that constitutes the said collar, the seaming flange being upset radially inwardly around a corresponding engagement surface of the ring or shroud, the latter having the mounting groove in which the abutment ring is mounted.

According to yet another preferred feature of the invention, the front end of the starter head pinion is blind.

Further features and advantages of the invention will appear more clearly on a reading of the detailed description of preferred embodiments of the invention which is given below, by way of example only and with reference to the accompanying drawings.

DESCRIPTION OF PREFERRED EMBODIMENTS OF THE INVENTION

Figure 1:
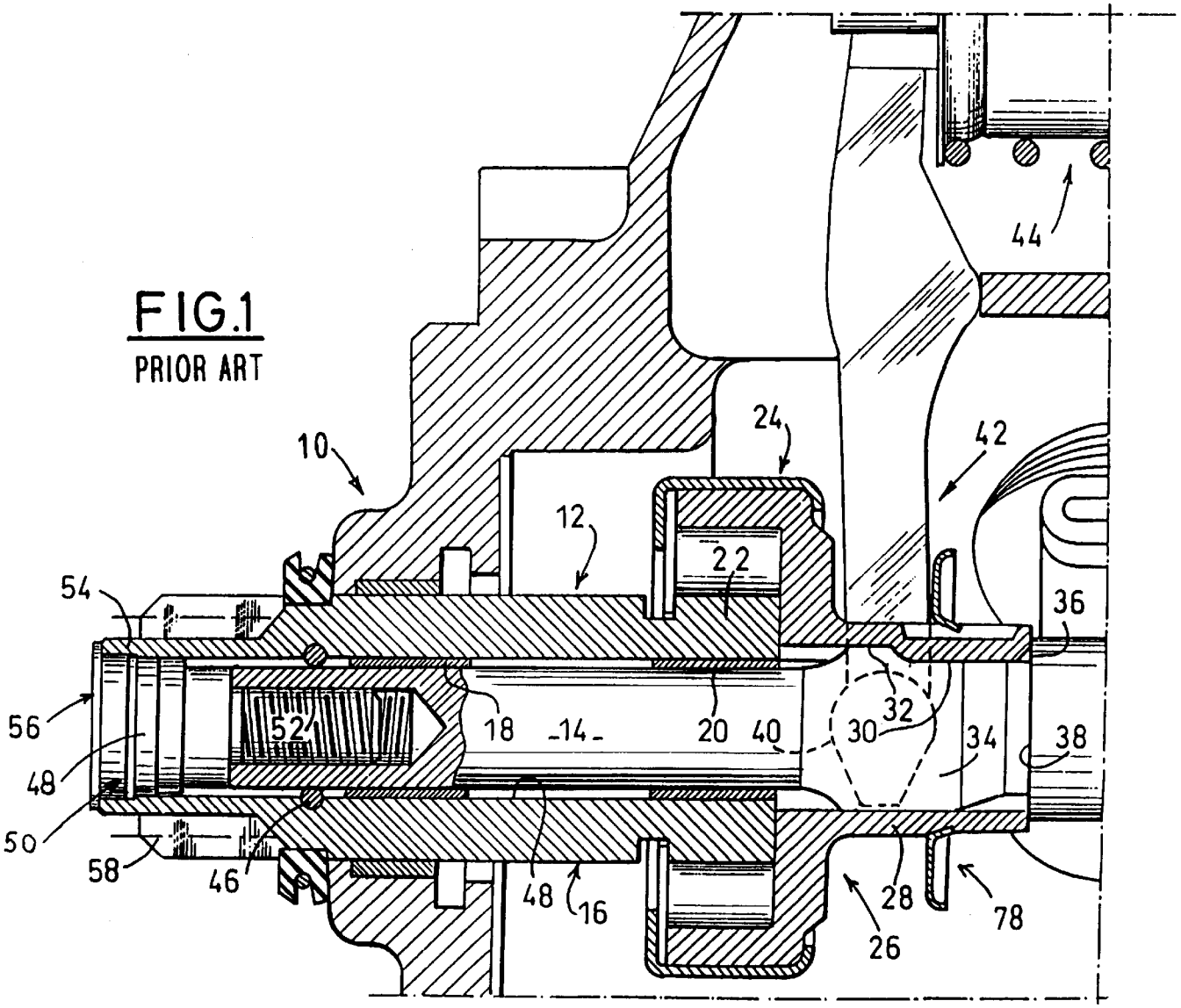
FIG.1 PRIOR ART
FIG. 1 is a partial view in axial cross section of a starter, the starter head of which is made in accordance with the current state of the art, the starter head being shown in its withdrawn, or rear or rest position.

FIG. 1 shows part of a starter 10 having a starter head 12, which consists essentially of a starter head shaft 14. A starter head pinion 16, of generally cylindrical tubular form, is mounted for sliding movement on the shaft 14, with a front guide sleeve 18 and a rear guide sleeve 20 being interposed, the guide sleeves 18 and 20 being spaced axially apart.

The rear end portion 22 of the starter head pinion 16 is received within a free wheel device 24 which is part of an actuator 26. The body of the actuator 26 consists of a tubular sleeve portion 28 which is formed with internal radial splines 30. The splines 30 cooperate with external, helical radial splines 32 formed on the rear end portion 34 of the starter head shaft 14.

The starter head pinion 16 is shown in FIG. 1 in its rearward, or withdrawn, or rest, position. In this position the transverse rear end face [26] 36 of the sleeve portion 28 bears axially against a radial shoulder 38 formed on the starter head shaft 14.

In order to determine the advanced, or working, axial position of the starter head pinion 16 with respect to the starter head shaft 14, an abutment ring 46 is provided. This ring 46 is fitted in an internal radial groove formed in the internal bore of the starter head pinion 16, and is arranged to cooperate with a collar portion 48 which is part of an end stop screw 50, the threaded body of which is screwed into a threaded bore 52 formed in the leading end of the starter head shaft 14.

The leading end portion 54 of the starter head pinion 16 is open so that the various components can be fitted to it, and it is closed sealingly by means of a cap 56. The end portion 54 has external teeth 58, which, when the starter head pinion is in its advanced or working position, are adapted to mesh with the teeth of the toothed starter crown (not shown) carried by the flywheel of the internal combustion engine which is to be started by means of the starter 10.

A first embodiment of the starter head 12 in accordance with the invention will now be described with reference to FIG. 2, and, in greater detail, with reference to FIGS. 3 to 6. In these Figures, those components or elements which are identical or similar to those in FIG. 1 are designated by the same reference numerals.

Here, the starter pinion 16 is in the form of a tubular cylindrical component, having a leading end portion 30 which is "blind" because it is closed by a base portion, and which is closed by a base 56 formed integrally with the body portion 17 of the starter head pinion 16. The starter head shaft 14 is in the form of a solid rod. The starter pinion 16 slides on the leading end portion 15 of the shaft 14, with the guide sleeves 18 and 20 being interposed between the bore of the pinion 16 and the cylindrical outer surface of the shaft 14. This outer surface is perfectly smooth, and, apart from a chamfer which may be formed, as shown, on its free end 15, its manufacture involves no other machining operation. Similarly, machining of the starter pinion 16 is greatly simplified as compared with that in the state of the art shown in FIG. 1, just as the leading end portion 15 of the shaft 14, which no longer involves any drilling or thread cutting, is also simplified.

The abutment means which determine the relative axial position of the starter head pinion 16 and its actuator 26 with respect to the starter head shaft 14, will now be described in detail with reference to FIGS. 2 and 3.

In the vicinity of its transverse rear end face 36, the internal bore 60 of the tubular sleeve portion 28 of the actuator 26 is formed with an internal radial groove 62. This groove 62 is bounded axially by a leading radial face 64 and a rear radial face 66. The internal diameter of the base 68 of the groove 62 is extended by a portion 69 having a frusto-conical profile.

The groove 62 is a mounting groove which is arranged to receive a split, toroidal, metal ring 70, which constitutes an abutment ring in the sense of the present invention. The axial thickness e of the ring 70 is smaller than the axial distance that separates the radial end faces 64 and 66 of the groove 62 from each other. The overall external diameter of the ring 70, when measured in the rest condition as shown in FIG. 3, is smaller than the overall diameter of the base 68 of the groove 62. The ring 70 is formed with a slit 72 so as to enable it to deform elastically in both the inward and outward radial directions.

The outer cylindrical surface 74 of the sleeve portion 74 includes, in a manner known per se, a groove 76 into which a collar 78 is fitted by seaming. The purpose of this collar 78 is to be engaged by the control lever or actuating fork 42 of the starter so as to move the actuator 26, and therefore the starter pinion 16, towards the rest position shown in FIG. 2. The actuating fork 42 is operated by a conventional hydraulic cylinder-type actuator 44, shown in FIG. 1.

Figure 3:
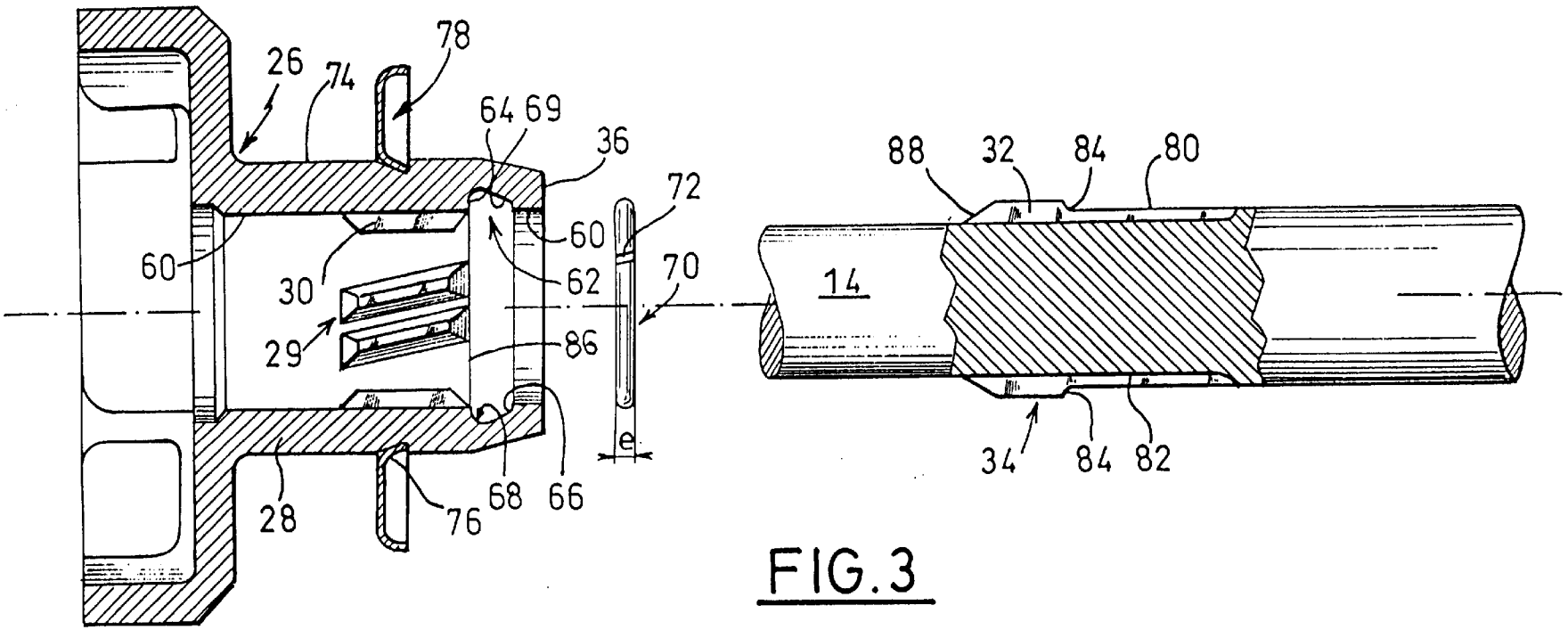
FIG. 3 is a view in axial cross section, and on a larger scale, of the actuator in the starter head, together with a portion of the associated starter head shaft, these components being shown before the starter head shaft is fitted into the starter head pinion.

As can be seen in FIG. 3, the splined portion 34 of the starter head shaft 14 has a set of helical splines 32 which project radially outwardly with respect to the outer cylindrical surface of the rear portion of the starter head shaft 14, that is to say the portion of the latter on the right hand side in FIG. 3. The base 82 of these splines 32 extends axially, partly, into the outer cylindrical wall 80 of the shaft 14, rearwardly from a rear transverse flank 84 formed on the splines 32. Thus, to the rear of this flank 84, the splines 32 are flush with the wall 80.

As can also be seen in FIG. 3, the front radial face 64 of the mounting groove 62 lies in the same radial plane as the rear transverse flank 86 of the internal splines 30 of the splined portion 29 of the sleeve portion 28 of the actuator 26.

Figure 4:
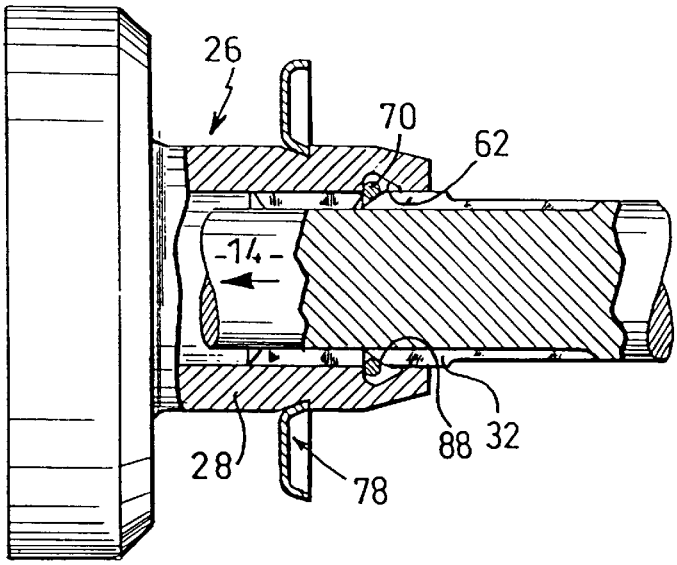
FIG. 4 is a view similar to that in FIG. 3, but shows these two components in the course of the axial introduction of the shaft into the actuator.
Figure 5:
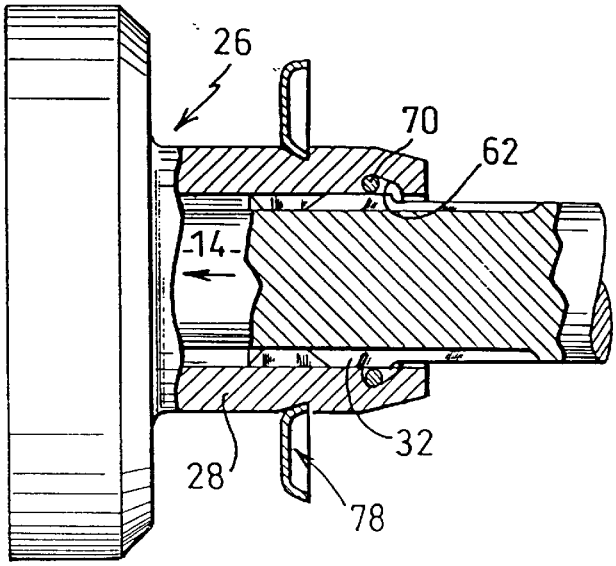
FIG. 5 is a view similar to that in FIG. 4, showing the next phase in the introduction of the starter head shaft.
Figure 6:
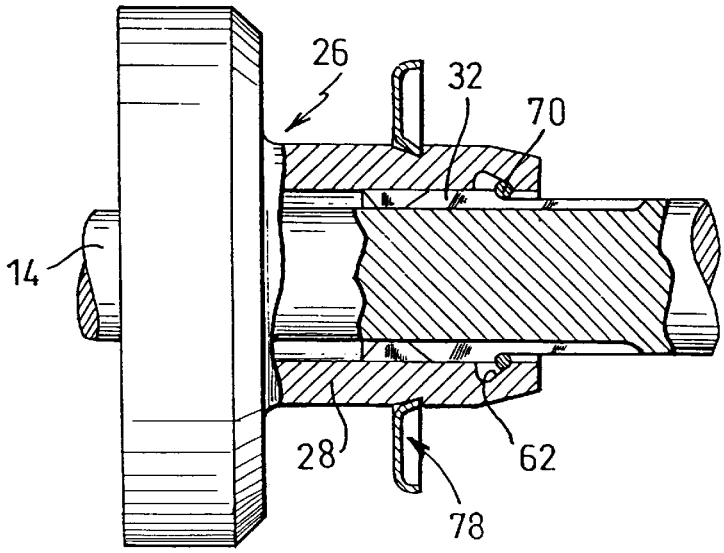
FIG. 6 is a view similar to those in FIGS. 4 and 5, but shows the relative position of the actuator with respect to the starter head shaft when the starter head is in its advanced or working position.

The abutment ring 70 is fitted into its mounting groove 62 by compressing it radially inwardly and then allowing it to relax within the groove 62, so that it then occupies the position shown in FIGS. 4 to 6.

The axial introduction of the starter head shaft 14 into the actuator 26, which is itself mounted on the starter pinion 16, is carried out from right to left with reference to FIG. 3. In a first phase of this fitting operation, shown in FIG. 4, it is the chamfered front transverse flank 88 of the splines 32 that make contact with the abutment ring 70, so as to cause the latter to be expanded radially outwardly within the groove 62.

The movement whereby the shaft 14 is introduced into the sleeve portion 28 is continued from the position shown in FIG. 4 to that shown in FIG. 5. In FIG. 5, the abutment ring 70 has expanded radially outwardly within its mounting groove 62, so that the portion of greatest diameter of the splines 32 on the splined portion 34 of the starter head shaft 14 can pass through the ring 70.

Figure 2:
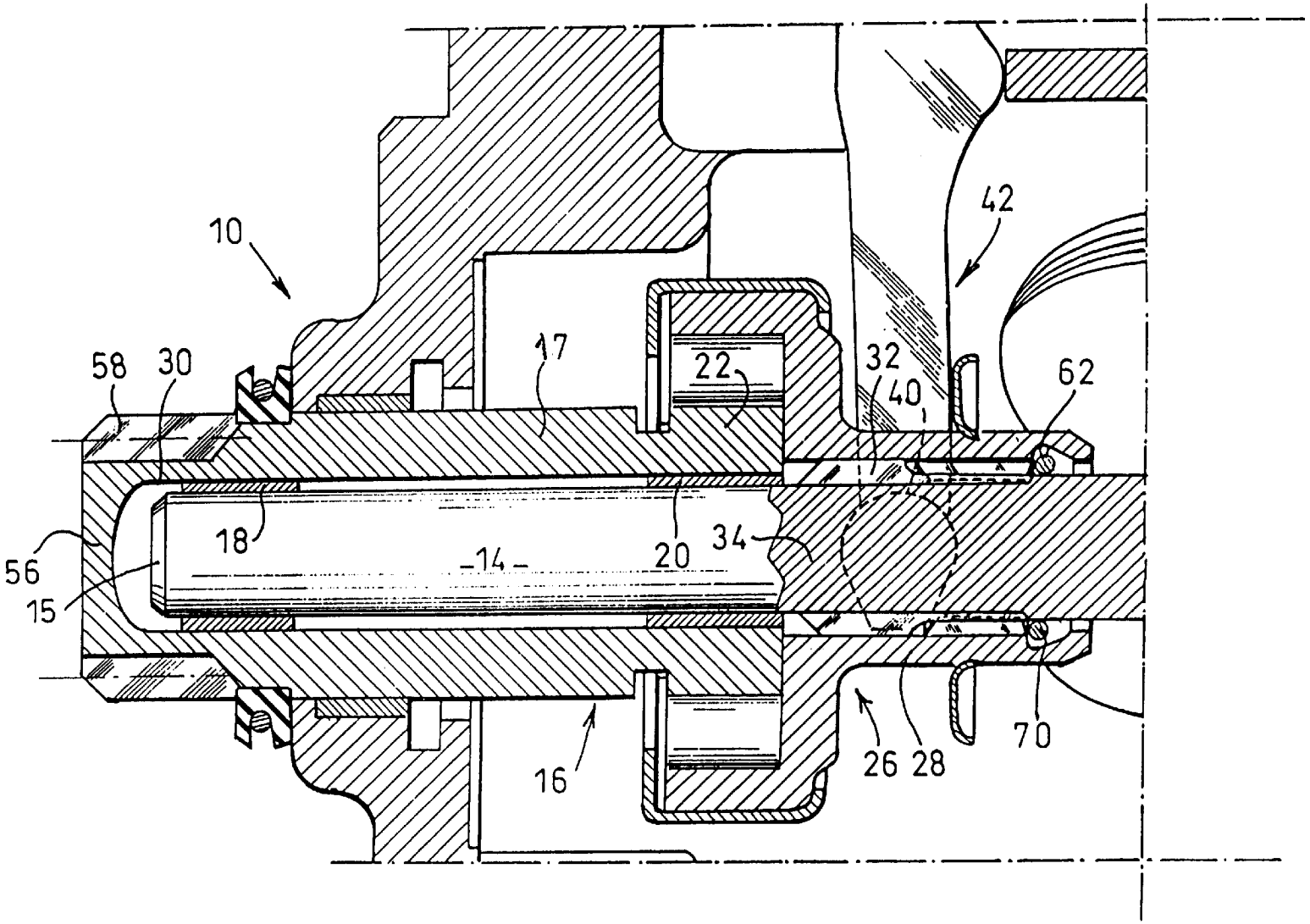
FIG. 2 is a view similar to that in FIG. 1, but shows a starter which incorporates an improved starter head in accordance with the present invention.

The movement is continued further, from the FIG. 5 position until the shaft 14 occupies the rest position, shown in FIG. 2, with respect to the actuator 26 and the starter pinion 16. In this position, the abutment ring 70 ceases to be expanded as in FIG. 5, but relaxes so that its diameter is once again its natural or rest diameter, that is to say a diameter which is slightly greater than the diameter of the outer cylindrical surface 80 in the flush portions of the splines 32. The abutment ring 70 can slide freely on these shallower, flush portions of the splines.

In this rest position, the abutment given by the ring 70 thus takes place on the end of the splines 32 of the starter head shaft 14 and on the beginning of the internal splines 30 of the sleeve portion 28, with the abutment ring 70 projecting radially inwardly and in facing relationship with the rear transverse flank 86 of the splines 30.

When the starter head is displaced from its rest position shown in FIG. 2 to the working position shown partly in FIG. 6, the axial abutment of the actuator 26, and therefore of the starter pinion 16, with respect to the starter head shaft 14, is obtained because the abutment ring 70 is interposed between the rear radial face 66 of the groove 62 and the rear transverse flank 84 of the external splines 32 of the starter head shaft 14. The axial abutment forces therefore give rise only to shear stresses in the annular abutment ring 70.

This design enables the number of components to be reduced because the end stop screw, such as the screw 50 in FIG. 1, is eliminated. Furthermore it is no longer necessary to provide an attached sealing cap such as the cap 56 in FIG. 1, while the number of profiles required, and the amount of machining needed in the starter head shaft 14 and pinion 16 (as explained above), are reduced.

The front guide sleeve 18 may be positioned close to the free front end 15 of the starter head shaft 14, thus reducing the length of cantilever in the working position. Finally, the total length of the starter pinion is reduced.

Figure 7:
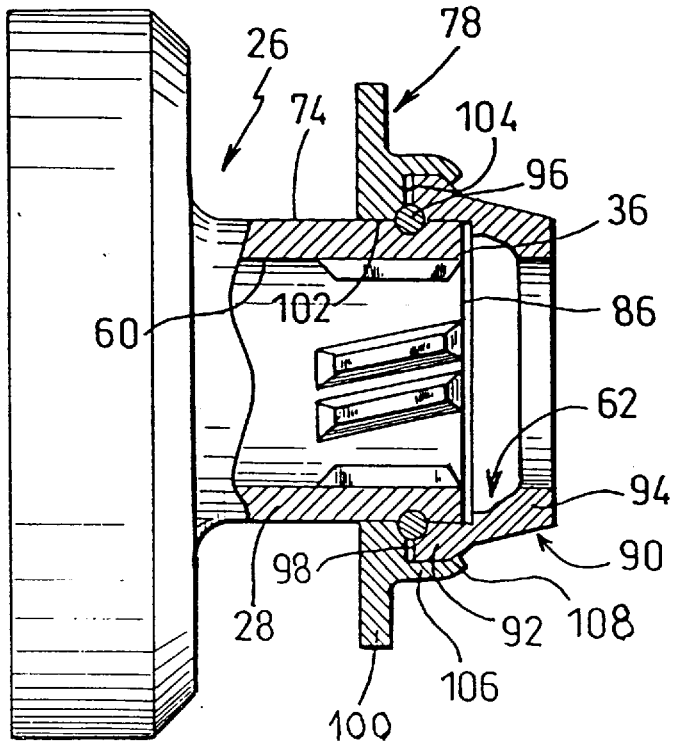
FIG. 7 is a view similar to the left hand part of FIG. 3, but shows another version of an actuator of a starter head shaft in accordance with the invention.

Reference is now made to FIG. 7, showing a modified embodiment of the actuator 26. Here, the sleeve portion 28 of the actuator is of reduced axial length, such that its transverse rear terminal face 36 lies in the same radial plane as the rear transverse flank 86 of the internal splines 30 of the sleeve portion 28. The sleeve portion 28 is extended axially towards the rear by means of an attached shroud or ring 90 which is formed with a mounting portion 92 fitted on the outer cylindrical surface 74 of the sleeve portion 28. The body 94 of the shroud 90 is formed with an internal radial recess, which constitutes the groove 62 in which the abutment ring 70, already described, is fitted. Accordingly, the transverse rear face 36 of the sleeve portion 28 constitutes the front radial face of the groove 62 in this case.

The shroud 90 is located axially with respect to the sleeve portion 28 by means of an external toroidal abutment ring 96 which defines a radial abutment shoulder, against which the front face 98 of the mounting portion 92 bears axially.

In this example, the collar 78 takes the form of a disc 100, which has a central hole 102 so that it can be mounted for sliding movement on the outer cylindrical surface 74 of the sleeve portion 28; and the collar 78 is positioned axially on the latter by means of its rear face 104, which bears against the abutment ring 96. The disc 100 also has an annular skirt portion defining a seaming flange 106, which fits over the mounting portion 92 of the shroud. The free rear terminal edge 108 of this skirt portion is upset over and around a conical facing surface of the mounting portion 92.

Assembly of the components of the actuator is carried out in the following way. The disc 100 constituting the collar 78 is first introduced, and the external abutment ring 96 is then fitted in position, after which the shroud 90 is fitted by means of its mounting portion 92. Finally, the seaming flange 106 is secured by upsetting the free terminal edge 108 over the above mentioned conical surface, as seen in FIG. 7, so as to give precise axial positioning of the components 90 and 78 with respect to the abutment ring 96.

This second embodiment enables the sleeve portion 28 to be made with a reduced thickness for forming the splines 30 by deformation of the material of the sleeve portion 28, instead of the splines 30 being formed by broaching, as is the case in the first embodiment described with reference to FIGS. 2 to 6. The actuator in the form shown in FIG. 7 is thus of a less expensive design.

What is claimed is:

1. A starter for a motor vehicle, having a control lever and a starter head, the head having a starter head shaft and a starter head pinion carried on the shaft for axial sliding movement thereon between a withdrawn position and a working position, the head further including an actuator for engagement by an end of the said lever to move the actuator between the said positions, the actuator being coupled with the pinion so that the pinion is movable with the actuator by the control lever, the actuator having a body comprising a sleeve portion mounted for sliding movement on the shaft, the sleeve portion having an internal bore including a portion having internal splines, the shaft having a portion defining external splines cooperating with said internal splines, the head further including abutment means interposed between the sleeve portion and the shaft for limiting the course of axial sliding movement of the pinion with respect to the shaft, when it slides toward the advanced or "working" position, wherein the said external splines define a transverse flank that constitutes the rearward axial end of the external splines, the abutment means comprising an abutment member coupled with the actuator for axial movement with the latter and arranged for cooperation with the said transverse flank of the external splines.

2. A starter according to claim 1, wherein the said bore of the sleeve portion defines an internal mounting groove, the abutment member being mounted in the mounting groove and projecting radially inwardly so as to lie facing the said rear transverse flank of the external splines.

3. A starter according to claim 2, wherein the said internal splines define a transverse flank thereof constituting the rearward end of the internal splines, the said mounting groove having a radial front face aligned with the said transverse flank of the internal splines.

4. A starter according to claim 3, wherein the mounting groove has a radial rear face, the said radial front and rear faces of the mounting groove being spaced apart by a distance greater than the axial thickness of the abutment ring.

5. A starter according to claim 2, wherein the mounting groove has a diameter greater than the external diameter of the abutment ring, the abutment ring being elastically deformable radially inwardly within the mounting groove.

6. A starter according to claim 2, wherein the mounting ring is a split toroidal ring.

7. A starter according to claim 2, wherein the said sleeve portion is a single component, the mounting groove being formed in the bore of the said component.

8. A starter according to claim 1, wherein the pinion has a blind front end.

9. A starter head for a starter according to claim 1.

* * * * *